US006220507B1

(12) United States Patent
Guillin

(10) Patent No.: US 6,220,507 B1
(45) Date of Patent: Apr. 24, 2001

(54) PACKAGING BOX FOR FOOD PRODUCTS

(75) Inventor: François Guillin, Mouthier Hautepierre (FR)

(73) Assignee: Groupe Guillin, Ornans (FR)

( * ) Notice: Subject to any disclaimer, the term of this patent is extended or adjusted under 35 U.S.C. 154(b) by 0 days.

(21) Appl. No.: 09/341,239

(22) PCT Filed: Jan. 13, 1999

(86) PCT No.: PCT/FR98/00049

§ 371 Date: Jul. 13, 1999

§ 102(e) Date: Jul. 13, 1999

(87) PCT Pub. No.: WO98/30457

PCT Pub. Date: Jul. 16, 1998

(30) Foreign Application Priority Data

Jan. 14, 1997 (FR) ..... 97 00292

(51) Int. Cl.[7] ..... B65D 5/12; B65D 25/64

(52) U.S. Cl. ..... 229/122.22; 229/122.21; 229/162; 220/62; 220/611; 220/602; 220/377

(58) Field of Search ..... 220/602, 377, 220/668, 62, 611, 617, 655; 229/122.22, 122.21, 162, 4.21, 199

(56) References Cited

U.S. PATENT DOCUMENTS

| | | | | |
|---|---|---|---|---|
| 1,069,834 | * | 8/1913 | White | 229/122.21 |
| 2,688,420 | * | 9/1954 | Bishop et al. | 220/668 |
| 3,406,816 | * | 10/1968 | Green et al. | 206/769 X |
| 4,700,883 | * | 10/1987 | Vajtay et al. | 229/125.17 |
| 5,074,461 | * | 12/1991 | Parker et al. | 229/125.13 |
| 5,507,430 | * | 4/1996 | Imhoff | 229/125.19 |
| 5,699,959 | * | 12/1997 | Huspeda et al. | 229/125.26 |
| 5,975,412 | * | 11/1999 | Guillin | 229/122.22 |

FOREIGN PATENT DOCUMENTS

| | | |
|---|---|---|
| 25 49 605 | 5/1977 | (DE) . |
| 2 310 936 | 12/1976 | (FR) . |
| WO 97/18996 | 5/1997 | (WO) . |

* cited by examiner

*Primary Examiner*—Allan N. Shoap
(74) *Attorney, Agent, or Firm*—Young & Thompson

(57) ABSTRACT

A packaging box comprising a closed crown (1) provided with at least two opposite transverse windows (4), a base (3) and a lid (2) for closing the crown (1). The lid (2) comprises a piece provided with a boss (5) for cooperating with the top opening of the crown (1) by fitting therein, and comprising at least two opposite side flaps (6) each provided with a boss (7) for cooperating with a window (4) of the crown (1) by fitting therein. The base (3) comprises a piece provided with a boss (8) for cooperating with the lower opening of the crown (1) by fitting therein and two opposite projections or tabs (9) each provided with locking elements (10) cooperating with complementary locking elements (11) of one of the flaps (6) of the lid (2). The invention is applicable to the packaging of food products.

6 Claims, 4 Drawing Sheets

PACKAGING BOX FOR FOOD PRODUCTS

CROSS REFERENCE TO RELATED APPLICATION

Figure 1:
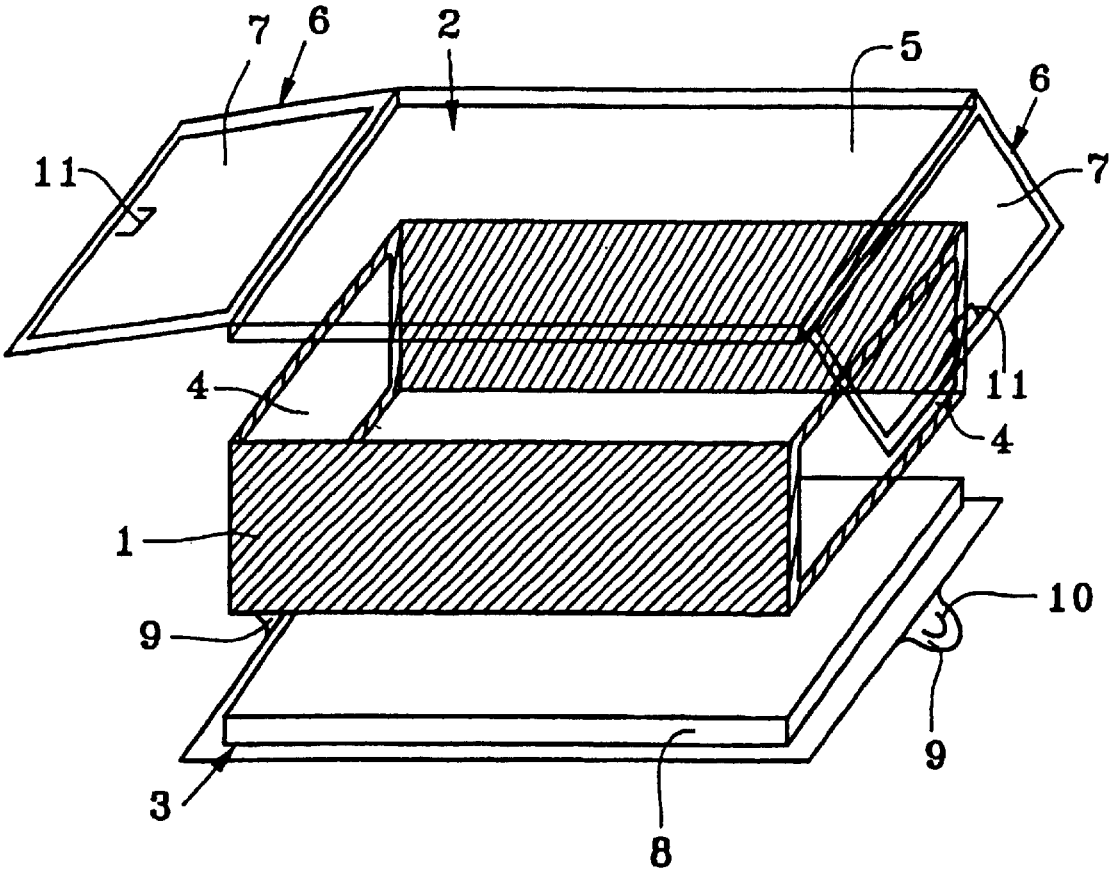

This is the 35 USC 371 national phase of international application PCT/FR98/00049 filed on Jan. 13, 1998, which designated the United States of America.

FIELD OF THE INVENTION

The invention relates to a packaging box, in particular for food products such as pastries, of the type comprising a surround provided with at least two opposite transverse windows, a bottom and a closure cover for said surround.

BACKGROUND OF THE INVENTION

Packaging boxes conventionally used by workers, particularly butchers, pastry chefs and candy makers, are generally of cardboard in the form of a blank that is cut out, folded and glued. These conventional boxes permit protection of the product which has been selected by the vendor on a shelf or in a showcase and then placed in the package, which can easily be decorated by printing and personalization with the name of the worker. Such a box, which gives the image of tradition and quality of workmanship, is not usable in industry and the distribution of foodstuffs because of its cost to make and fill. It suffers moreover from the major drawback of not permitting the contained food product to be seen.

To overcome this last drawback, there have been developed cardboard boxes to which is applied a transparent cover or film or in which the walls are provided with openings closed by a transparent or translucent film.

There have also been proposed packaging boxes entirely in transparent or translucent material, which permits complete and direct viewing of the product contained therein. In this case, there are conventionally used boxes constituting a single piece of thermoformed plastic material. However, these boxes are inappropriate for high grade contents, such as for example pastries, because of their relatively poor and unworthy appearance.

There are also known, from French patent application 95-13782, packaging boxes of the type comprising a bottom, a surround and a cover articulated on said surround, the cover and the bottom being in the form of a triptych comprising two surfaces each articulated to one connecting member and said surfaces comprising members for abutment against the internal and/or external periphery of the respective edge of said surround, separate closure means being integrated in the triptych and/or in the surround or being provided after closure of the box.

However, the setting up of the box from a base and cover in the form of a triptych is relatively complicated.

SUMMARY OF THE INVENTION

The object of the present invention is to improve a packaging box of the type comprising a closed surround, a bottom and a cover, so as to render its production simple and economical and to facilitate setting it up, closing it and locking it closed.

To this end, the present invention has for its object a packaging box of the type comprising a closed surround provided with at least two opposite transverse windows, a bottom and a closure cover for said surround, characterized in that (a) the cover comprises a piece provided with a projection adapted to nest in the upper opening of the surround and comprising at least two opposite side flaps each provided with a projection adapted to next in a window of the surround, and (b) the bottom comprises a piece provided with a projection adapted to nest in the lower opening of the surround as well as two opposite projections or tongues each provided with the locking means coacting with a complementary locking means on one of the flaps of the cover.

Thus, the surround is emplaced on the bottom such that the tongues, disposed on opposite sides of the bottom, correspond with the surfaces of the surround comprising the windows. Then the cover is nested in the upper opening of the surround such that the flaps can cover the windows of the surround, the projections of said flaps nesting in the windows, then the packaging box is locked closed by simple coaction of the locking means carried by the tongues of the bottom with the complementary locking means carried by the flaps of the cover.

Preferably, the cover and the bottom are made by thermoforming from a translucent or transparent plastic material.

Thus, preferably, the locking means are of the tongue/slot type, known per se, and are obtained by a simple cutting of the material constituting the bottom of the cover.

Preferably, the closed surround has a cylindrical shape with a lower opening adapted to coact with the piece constituting the bottom and an upper opening adapted to accommodate the piece constituting the cover.

According to the shape it is desired to give to the box, the surround can be a parallelepiped or pyramid.

The shape and dimensions of the bottom end of the cover, in particular of the projections, are selected so as to correspond respectively to the lower and upper openings of the surround.

According to one embodiment of the invention, the surround comprises four windows, the cover then comprising four side flaps provided respectively with a projection adapted to nest in a window of the surround and a bottom comprising four tongues provided with locking means coacting with the complementary locking means carried by the flaps of the cover.

According to a preferred embodiment, the surround comprises four windows and the cover and the bottom are constituted by two identical pieces, one piece comprising a projection suitable to nest in the upper or lower opening of the surround and comprising two opposite side flaps provided with projections and two tongues, each tongue of one piece being provided with a locking means coacting with the complementary locking means of a flap of the other piece.

Thus, a surround is emplaced on a first piece acting as the bottom, then there is installed a second piece acting as a cover in the upper opening of the surround such that the locking means carried by the tongues of the bottom coact with the complementary locking means carried by the side flaps of the cover and that the locking means carried by the tongues of the cover coact with the locking means carried by the side flaps of the bottom.

There is thus obtained a packaging box whose production and setting up are much simpler in that the bottom and the cover are identical and

Figure 1A:
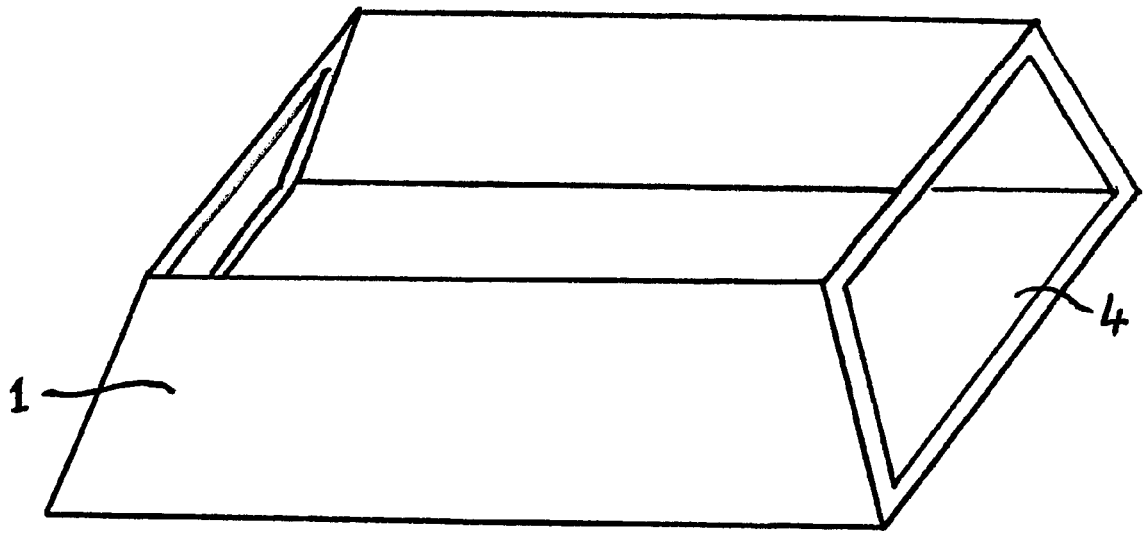
Figure 2:
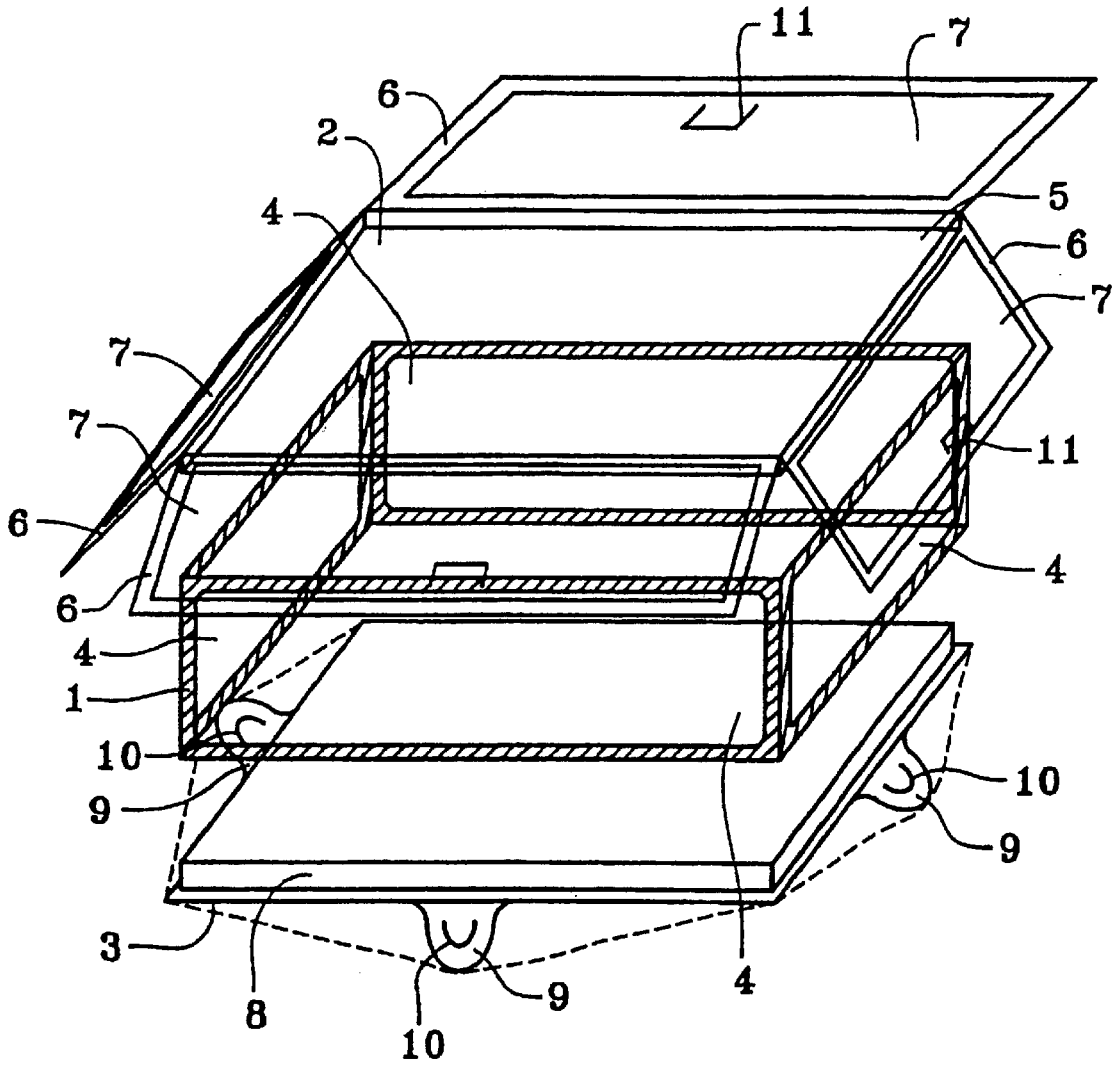
Figure 3:
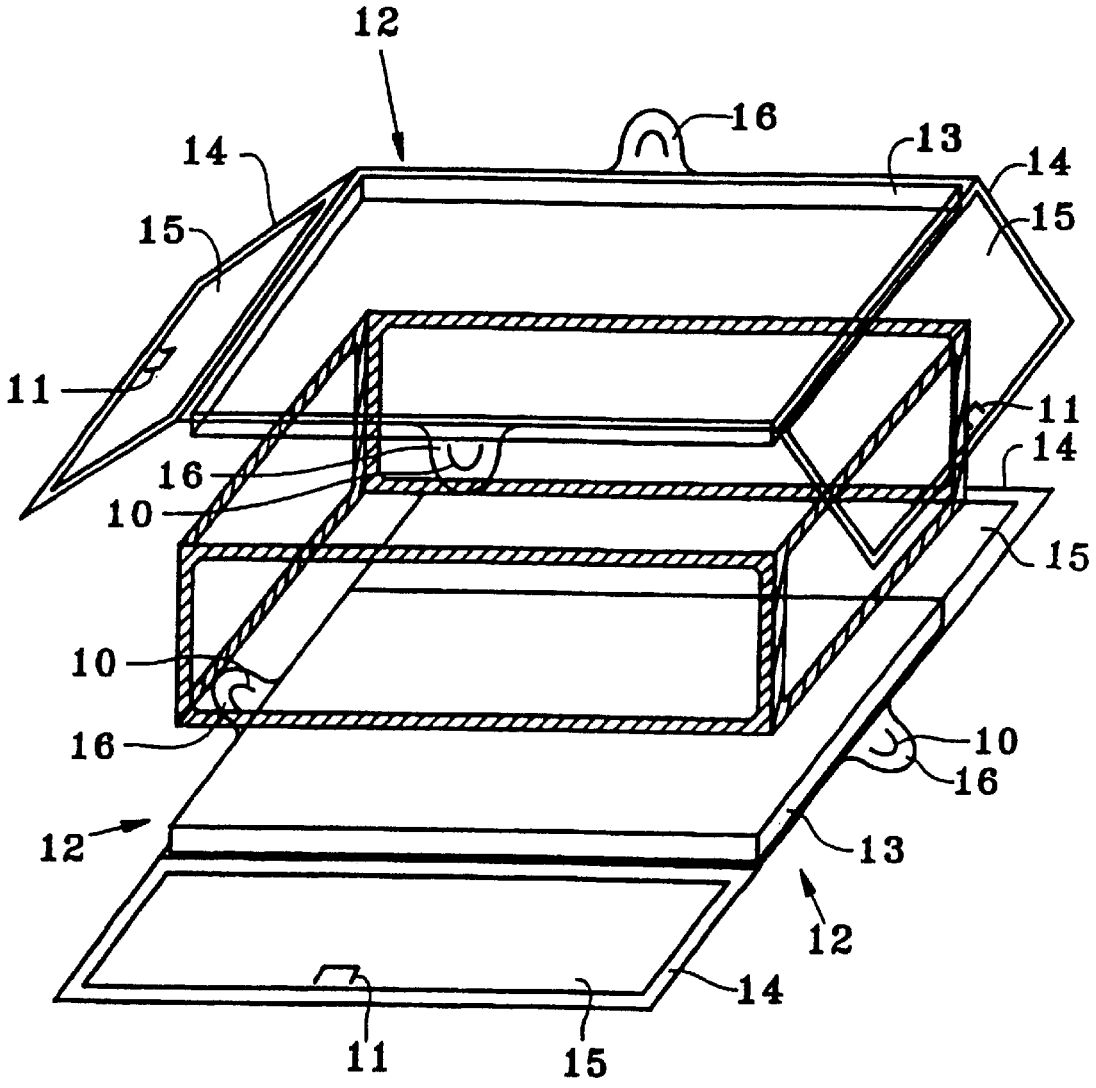

BRIEF DESCRIPTION OF THE DRAWINGS there will now be described the invention in greater detail with reference to the drawings, in which:

FIG. 1 shows an exploded schematic perspective view of a box according to a first embodiment of the invention;

FIG. 1*a* shows a truncated pyramidal surround;

FIG. 2 shows an exploded schematic perspective view of a modified embodiment of a box according to FIG. 1; and FIG. 3 shows an exploded perspective view of a second embodiment of a box according to the invention.

DESCRIPTION OF THE PREFERRED EMBODIMENTS

The packaging box according to the invention shown in FIG. 1 comprises a closed surround 1 having two opposite transverse windows 4, a cover 2 and a bottom 3.

The surround 1 is a parallelepiped having an upper opening and a lower opening. The surround 1 may also be a truncated as shown in FIG. 1*a*.

The cover 2 comprises a piece provided with a projection 5 adapted to coact with the upper opening of the surround 1. The cover 2 moreover comprises two opposite side flaps 6 provided respectively with a projection 7 adapted to coact with the window 4 of the surround 1.

The bottom 3 is constituted by a piece provided with a projection 8 adapted to coact with the lower opening of the surround 1. So as to carry out the closing of the box, the bottom 3 comprises two opposite tongues 9 having respectively locking means 10 coacting with the complementary locking means 11 provided on the flap 6.

During use of the box according to the invention, the product to be packaged is placed on the bottom 3, then the surround 1 is placed on the bottom 3, said surround 1 being nested over the projection 8 such that the tongues 9 of the bottom 3 are in correspondence with the windows 4 of the surround 1.

The cover 2 is then emplaced, the projection 5 nesting in the upper opening of the surround 1. The cover 2 is positioned such that the flaps 6 can extend along the windows 4 of the surround 1.

The box is then closed by nesting the projections 7 in the windows 4 and is locked closed by coaction of the locking means 10 carried by the tongues 9 with the complementary locking means 11 carried by the flaps 6.

Preferably, the locking means 10 of the tongues 9 are small flaps coacting with slots 11 as complementary locking means on the flaps 6.

There is thus obtained a box which is easy to use, in particular as concerns emplacement of the product inside it. This is particularly practical in the case of use of these boxes for pastry.

So as to promote viewing of the product enclosed in the box, the surround 1 can comprise four windows 4 (FIG. 2) and, in this case, the cover 2 comprises two supplemental opposite side flaps 6 and the bottom 3 comprises two supplemental tongues 9.

There is also shown in FIG. 2, in broken line by way of example, a modified embodiment of the tongues 9.

According to a second embodiment of the invention, the surround 1 again comprises four windows 4 and the bottom 3 and the cover 2 are constituted by two identical pieces 12. A piece 12 comprises a projection 13 adapted to coact by nesting in the upper opening of the surround 1 or in its lower opening.

This piece 12 comprises two opposite side flaps 14, provided respectively with a projection 15, adapted to coact with the window 4 of the surround 1, and two tongues 16. The tongues 16 are provided with locking means 10 and side flaps 14 carry complementary locking means 11 for said locking means 10.

Thus, upon use of the box according to this embodiment of the invention, the product to be packaged is placed on one piece 12 used as a bottom, and the surround 1 is nested over the projection 13 of the bottom. The projection 13 of a second identical piece 12 is nested within the upper opening of the surround 1 used as a cover, by positioning the second piece 12 90° relative to the first.

As a result, this second piece 12 is positioned such that the flaps 14 of the cover are located in correspondence respectively with the tongues 16 of the bottom, the flaps 14 of the bottom thus being located in corresponding with the tongues 16 of the cover. The box is closed by nesting the projections 15 of the side flaps 14 in the windows 4 of the surround 1 and the closure of the box is locked by coaction of locking means 10 with complementary locking means 11.

What is claimed is:

1. A packaging box comprising:

a closed surround provided with at least two transverse opposite windows, a bottom, and a cover for closing said surround;

a) the cover comprising a piece provided with a projection adapted to nest in an upper opening of the surround and comprising at least two opposite side flaps each provided with a projection adapted to nest in a window of the surround; and b) the bottom comprising a piece provided with a projection adapted to nest within a lower opening of the surround and two opposite tongues each provided with a locking means coacting with a complementary locking means on one of the flaps of the cover;

said locking means carried by said tongues comprising small flaps coacting with slots acting as the complementary locking means carried by the flaps.

2. The packaging box according to claim 1, wherein the cover is made by thermoforming a transparent or translucent material.

3. The packaging box according to claim 1, wherein the bottom is thermoformed from a transparent or translucent plastic material.

4. The packaging box according to claim 1, wherein the closed surround is one of a parallelepiped and a truncated pyramid.

5. The packaging box according to claim 4, wherein the shape and dimensions of the cover and of the bottom are respectively chosen as a function of the shape and dimensions of the upper and lower openings of the surround.

6. The packaging box according to claim 1, wherein the closed surround comprises four windows, the cover then comprising four side flaps and the bottom comprising four tongues provided with locking means coacting with the complementary locking means carried by the flaps of the cover.

* * * * *